US006851273B2

(12) United States Patent
Jang et al.

(10) Patent No.: US 6,851,273 B2
(45) Date of Patent: Feb. 8, 2005

(54) AIR CONDITIONER AND OUTDOOR UNIT THEREFOR

(75) Inventors: Sae-Dong Jang, Gyeonggi-Do (KR); Il-Nahm Hwang, Gyeonggi-Do (KR); Jin-Seob Song, Gyeonggi-Do (KR); Bong-Soo Park, Seoul (KR); Dong-Jun Yang, Seoul (KR); Ho-Jong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/720,114

(22) Filed: Nov. 25, 2003

(65) Prior Publication Data

US 2004/0216480 A1 Nov. 4, 2004

(30) Foreign Application Priority Data

May 1, 2003 (KR) ..... 10-2003-0028044

(51) Int. Cl.[7] ..... F25B 13/00
(52) U.S. Cl. ..... 62/324.5; 62/139; 62/278
(58) Field of Search ..... 62/139, 196.4, 62/278, 324.1, 324.5, 324.6, 325

(56) References Cited

U.S. PATENT DOCUMENTS 4,698,981 A * 10/1987 Kaneko et al. ..... 62/180
4,770,000 A * 9/1988 Kuroda et al. ..... 62/156
4,901,534 A * 2/1990 Nakatsuno et al. ..... 62/81
6,244,057 B1 * 6/2001 Yoshida et al. ..... 62/160
6,351,959 B1 * 3/2002 Hirota ..... 62/198
6,584,796 B2 * 7/2003 Itoh et al. ..... 62/324.1
6,666,043 B2 12/2003 Lee
2004/0003604 A1 1/2004 So et al.

FOREIGN PATENT DOCUMENTS

JP 2000146319 A * 5/2000
JP 2001253227 A * 9/2001

* cited by examiner

*Primary Examiner*—Melvin Jones
(74) *Attorney, Agent, or Firm*—Greenblum & Bernstein, P.L.C.

(57) ABSTRACT

An air conditioner comprising an outdoor unit and an indoor unit provided with an indoor heat exchanger and an indoor expansion device, wherein the outdoor unit comprises a compressor for compressing a refrigerant, an outdoor heat exchanger for heat-exchanging a refrigerant, a four-way valve adjacently arranged to the compressor for circulating a refrigerant discharged from the compressor according to a heating cycle or a cooling cycle, and a refrigerant detouring path for detouring a refrigerant discharged from the outdoor heat exchanger to the compressor at the time of a defrosting operation, thereby performing the defrosting operation without stopping the heating cycle and thus preventing an indoor heating loss.

16 Claims, 4 Drawing Sheets

AIR CONDITIONER AND OUTDOOR UNIT THEREFOR

BACKGROUND OF THE INVENTION

1. Field of the Invention

The present invention relates to an air conditioner performing heating or cooling operations by using a heat pump cycle, and more particularly, to an air conditioner provided with an outdoor unit and capable of performing its own defrosting operation at the time of heating.

2. Description of the Conventional Art

Generally, an air conditioner is a device for controlling temperature, humidity, current, and cleanliness of air for comfortable indoor circumstances. By a construction of a unit, the air conditioner is divided into an integral type air conditioner for accommodating both an indoor unit and an outdoor unit in a single case, and a separated type air conditioner for constituting a compressor and a condenser as an outdoor unit and constituting an evaporator as an indoor unit. Addition to this, there is an air conditioner for both heating and cooling which can selectively perform heating and cooling by switching a refrigerant path with a four-way valve.

Recently, a multi-type air conditioner provided with a plurality of indoor units for heating or cooling according to each indoor space is being used. The multi-type air conditioner is provided with a plurality of compressors or a plurality of outdoor units connected to each other in parallel in order to effectively perform heating or cooling correspondingly to the number of the indoor units.

FIG. 1 is a schematic view showing one embodiment of an air conditioner in accordance with the conventional art. As shown, the conventional air conditioner is divided into an indoor unit 11 and an outdoor unit 21, and the indoor unit 11 is composed of an indoor heat exchanger 13 for heat-exchanging a refrigerant indoors and an indoor expansion device 15 for depressurization-expanding a refrigerant.

The outdoor unit 21 is composed of a compressor 23 for compressing refrigerant gas, an outdoor heat exchanger 33 for heat-exchanging a refrigerant with external air, a four-way valve 31 adjacently arranged to the compressor 23 for circulating a compression refrigerant discharged from the compressor 23 according to a heating cycle or a cooling cycle, an accumulator 35 arranged at an inlet of the compressor 23 for filtering a liquefied refrigerant, a first refrigerant path 41 for connecting the outdoor heat exchanger 33 to the indoor unit 11, and a second refrigerant path 42 for connecting the four-way valve 31 to the indoor unit 11.

Also, an oil separator 25 for separating oil, an oil returning path 29 for recycling oil separated by the oil separator 25 into the compressor 23, and a check valve 27 for preventing a backflow of a refrigerant are installed between an outlet of the compressor 23 and the four-way valve 31.

A receiver 37 for temporarily receiving a refrigerant and a drier 39 for removing moisture are installed in the middle of the first refrigerant path 41, and service valves 45*a* and 45*b* are respectively installed at the first and second refrigerant paths 41 and 42.

Both heating and cooling are operated in said conventional air conditioner. First, in case of the cooling operation, a refrigerant compressed in the compressor 23 is introduced into the outdoor heat exchanger 33 by the four-way valve 31, and the refrigerant which has passed through the outdoor heat exchanger 33 is introduced into the indoor expansion device 15 and the indoor heat exchanger 13 of the indoor unit 11 through the first refrigerant path 41. Also, the refrigerant which has passed through the indoor unit 11 is introduced into the four-way valve 31 through the second refrigerant flow 42, and the refrigerant which has passed through the four-way valve 31 passes through the accumulator 35 thus to be introduced into the compressor 23. Accordingly, by said cooling cycle of a refrigerant, the cooling operation of the air conditioner is performed.

Also, in case of the heating operation, the refrigerant compressed in the compressor 23 passes through the indoor expansion device 15 and the indoor heat exchanger 13 of the indoor unit 11 by the four-way valve 31 through the second refrigerant path 42, and the refrigerant discharged from the indoor unit 11 is introduces into the outdoor heat exchanger 33 through the first refrigerant path 41. The refrigerant which has passed through the outdoor heat exchanger 33 passes through the four-way valve 31 and the accumulator 35 thus be introduced into the compressor 23. Accordingly, by said heating cycle of a refrigerant, the heating operation of the air conditioner is performed.

Meanwhile, during the heating operation, frost is generated on a surface of the outdoor heat exchanger 33, and in order to remove the frost, the heating operation is periodically stopped and a defrosting operation is performed. A defrosting cycle of a refrigerant for performing the defrosting operation is formed of a reverse cycle of the heating cycle like the cooling cycle.

FIG. 2 is a schematic view showing another embodiment of the air conditioner in accordance with the conventional art. As shown, a plurality of outdoor units 21 having the same structure as the aforementioned embodiment are installed in parallel in order to enhance efficiency of the air conditioner in case that great cooling and heating capacity is required. Also, each outdoor unit 21 is connected to main paths 48 and 47 for introducing and discharging a refrigerant into the indoor unit 11 thus to perform cooling and heating operations.

In said conventional air conditioner, a refrigerant which has performed the defrosting operation of the outdoor heat exchanger 33 passes through the indoor expansion device 15 and the indoor heat exchanger 13 of the indoor unit 11. Accordingly, when the defrosting operation is performed after stopping the heating operation, a refrigerant which circulates through the indoor expansion device 15 and the indoor heat exchanger 13 during the heating operation is at once reversely circulated thus to cause noise of the indoor unit 11.

Moreover, in case that a plurality of the outdoor units 21 of the air conditioner are arranged, when one outdoor unit 21 among the plurality of outdoor units 21 performs the defrosting operation, the heating operation of all the outdoor units 21 has to be stopped and the defrosting operation has to be simultaneously performed. Accordingly, the heating operation of the plurality of indoor units 11 connected to the outdoor units 21 is all stopped thus to generate indoor heat loss.

SUMMARY OF THE INVENTION

Therefore, an object of the present invention is to provide an air conditioner capable of preventing noise generated indoors by preventing a refrigerant from being introduced into an indoor unit by constituting a defrosting cycle so that a refrigerant can circulate in an outdoor unit itself at the time of a defrosting operation of the outdoor unit, and an outdoor unit therefor.

Another object of the present invention is to provide an air conditioner capable of consecutively performing a heating operation of an indoor unit and preventing an indoor heat loss by constructing each outdoor unit to separately perform defrosting and heating operations in case that a plurality of outdoor units are arranged by preventing a refrigerant from being introduced into the indoor unit by constructing a defrosting cycle so that the refrigerant can circulate in the outdoor unit itself at the time of defrosting operation of the outdoor unit, and an outdoor unit therefor.

To achieve these and other advantages and in accordance with the purpose of the present invention, as embodied and broadly described herein, there is provided an air conditioner comprising an outdoor unit and an indoor unit provided with an indoor heat exchanger and an indoor expansion device, wherein the outdoor unit comprises a compressor for compressing a refrigerant; an outdoor heat exchanger for heat-exchanging a refrigerant; a four-way valve adjacently arranged to the compressor for circulating a refrigerant discharged from the compressor according to a heating cycle or a cooling cycle; and a refrigerant detouring path for detouring a refrigerant discharged from the outdoor heat exchanger to the compressor at the time of a defrosting operation.

To achieve these and other advantages and in accordance with the purpose of the present invention, as embodied and broadly described herein, there is also provided an outdoor unit for an air conditioner comprising a compressor; an outdoor heat exchanger for heat-exchanging a refrigerant with external air; a four-way valve adjacently arranged to the compressor, for changing a flow-path of a refrigerant for circulating a refrigerant according to a heating cycle or a cooling cycle; a first refrigerant path for connecting the outdoor heat exchanger to an indoor unit; a second refrigerant path for connecting the four-way valve to the indoor unit; a refrigerant detouring path connected to the first refrigerant path by a first three-way valve and connected to the second refrigerant path by a second three-way valve for detouring a refrigerant at the time of a defrosting cycle; an outdoor expansion device installed in the middle of the refrigerant detouring path for lowering a pressure of a refrigerant which flows in the refrigerant detouring path; and a heat exchanging unit installed between the outdoor expansion device and the second three-way valve for heat-exchanging a refrigerant which has passed through the outdoor expansion device.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
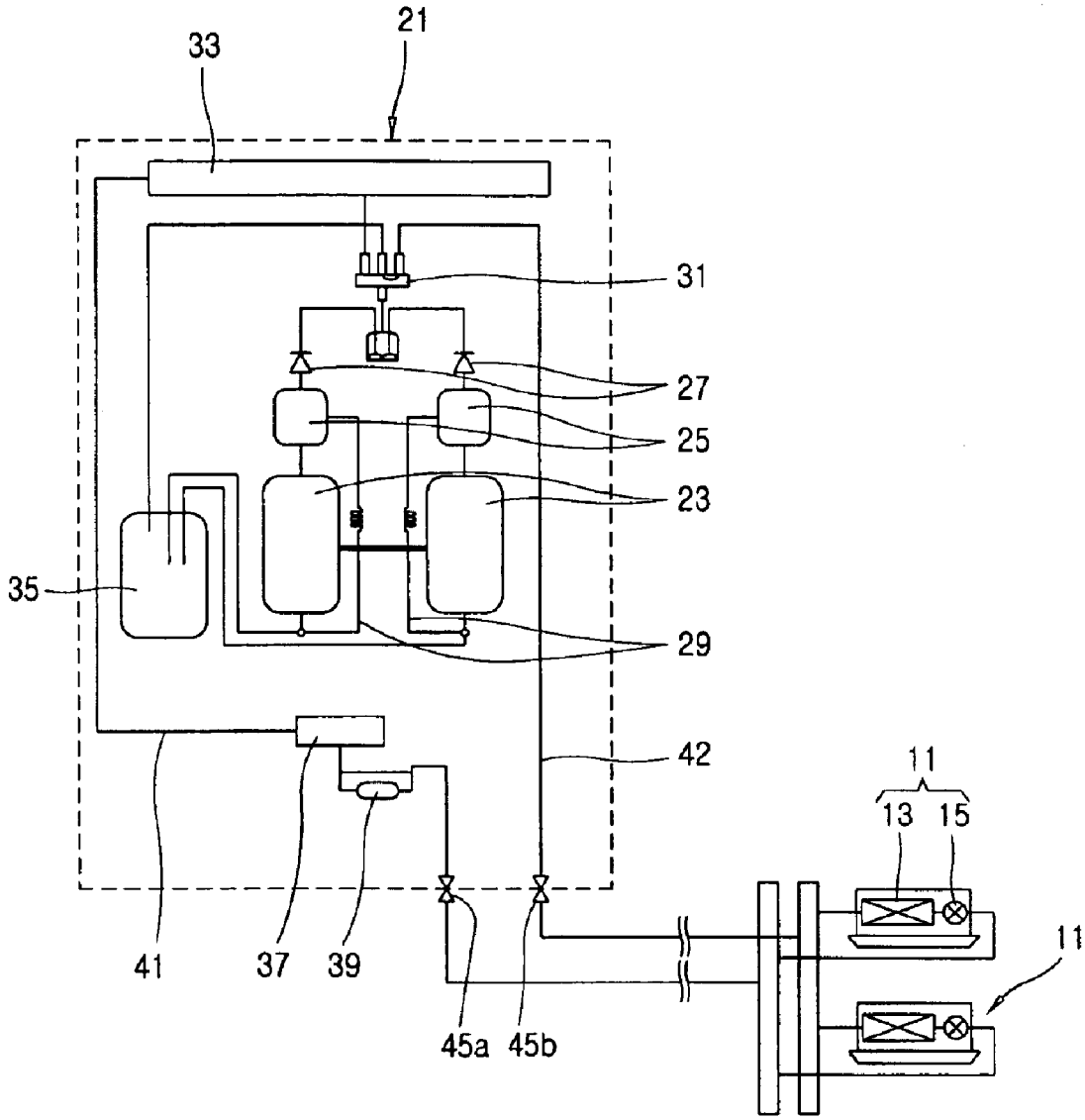
FIG. 1 CONVENTIONAL ART
FIG. 1 is a schematic view showing one embodiment of an air conditioner in accordance with the conventional art.
Figure 2:
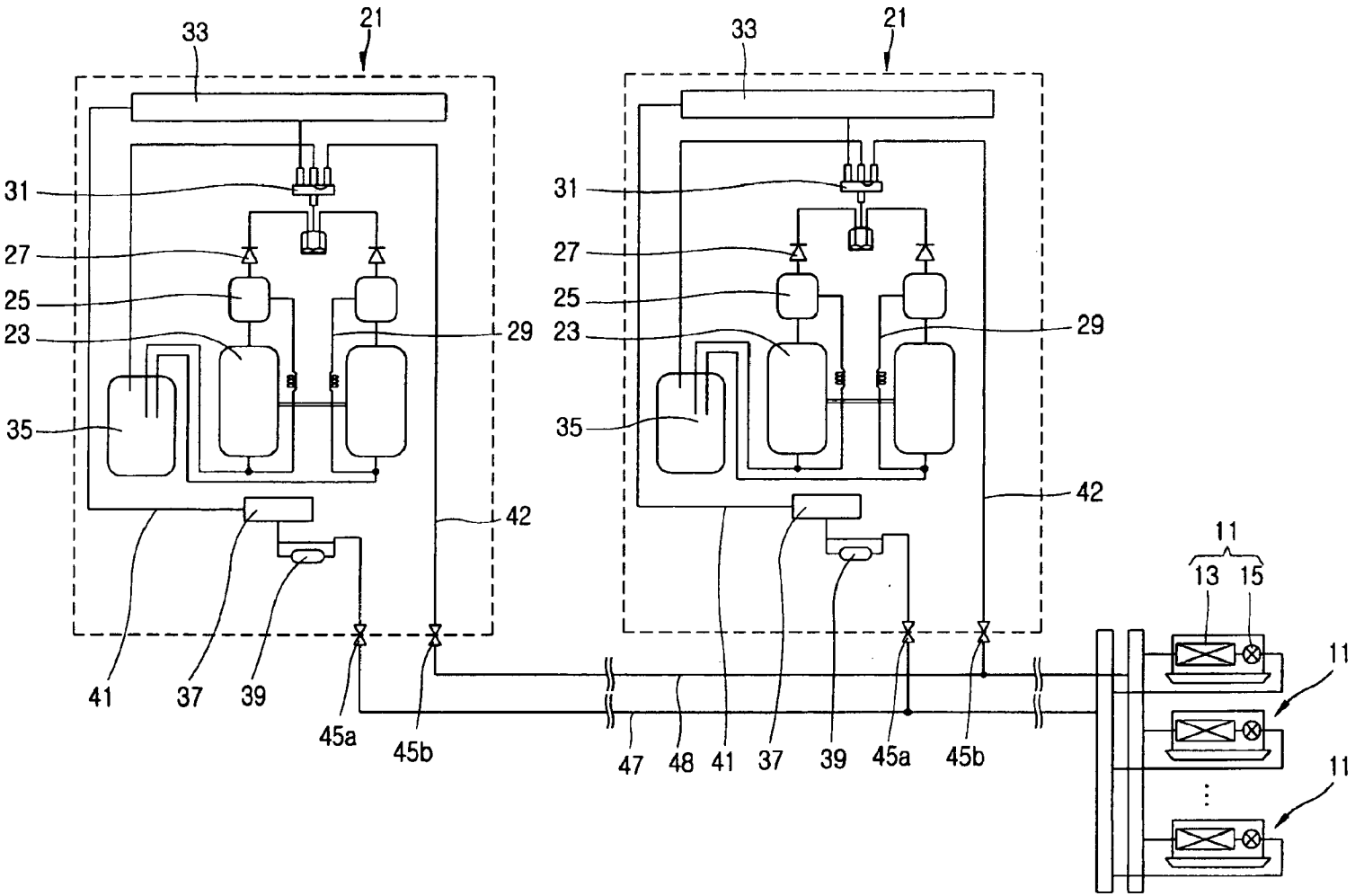
FIG. 2 CONVENTIONAL ART
FIG. 2 is a schematic view showing another embodiment of the air conditioner in accordance with the conventional art.
Figure 3:
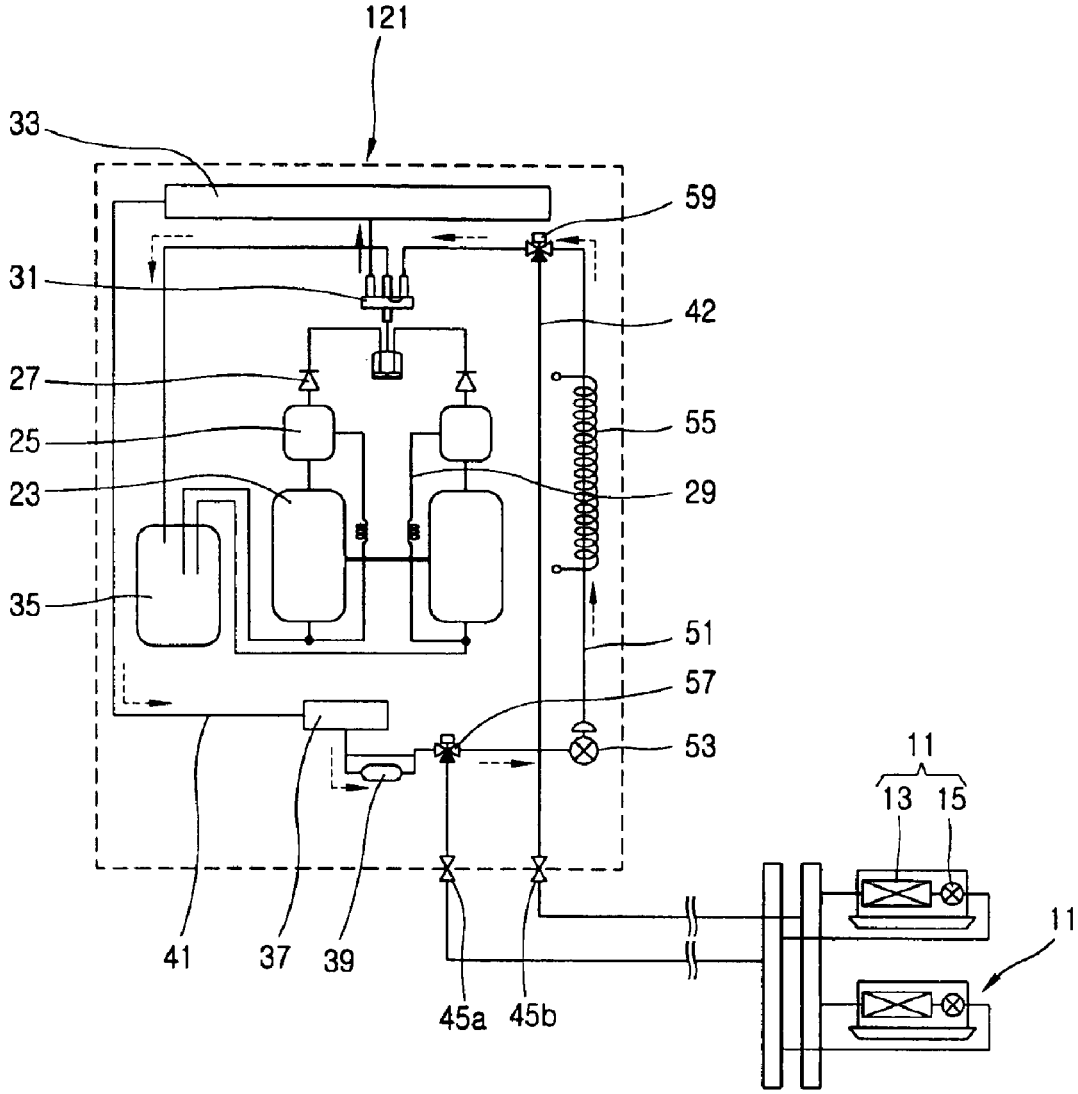
FIG. 3 is a schematic view showing one embodiment of an air conditioner according to the present invention.

FIG. 3 is a schematic view showing one embodiment of an air conditioner according to the present invention. As shown, the air conditioner is composed of a plurality of indoor units 11 constituted with an indoor heat exchanger 13 for heat-exchanging a refrigerant and an indoor expansion device 15 and arranged in parallel, and an outdoor unit 121. The outdoor unit 121 and the indoor units 11 are connected to each other by a connection pipe.

The outdoor unit 121 comprises a compressor 23 for compressing refrigerant gas, an outdoor heat exchanger 33 for heat-exchanging a refrigerant with external air, a four-way valve 31 adjacently arranged to the compressor 23, for changing a flow-path of a refrigerant for circulating a refrigerant according to a heating cycle or a cooling cycle, an accumulator 35 arranged at an inlet of the compressor 23 for filtering a liquefied refrigerant, a first refrigerant path 41 for connecting the outdoor heat exchanger 33 to an indoor unit 11, a second refrigerant path 42 for connecting the four-way valve 31 to the indoor unit 11, a refrigerant detouring path 51 connected to the first refrigerant path 41 by a first three-way valve 57 and connected to the second refrigerant path 42 by a second three-way valve 59 for detouring a refrigerant at the time of a defrosting cycle, an outdoor expansion device 53 installed in the middle of the refrigerant detouring path 51 for lowering a pressure of a refrigerant which flows in the refrigerant detouring path 51, and a heat exchanging unit 55 installed between the outdoor expansion device 53 and the second three-way valve 57 for heat-exchanging a refrigerant which has passed through the outdoor expansion device 53.

The heat exchanging unit 55 is formed of a heat conducting coil which winds the refrigerant detouring path 51, and the outdoor expansion device 53 is formed as an electronic expansion valve.

Also, an oil separator 25 for separating oil contained in a refrigerant, an oil returning path 29 for recycling oil separated by the oil separator 25 into the compressor 23, and a check valve 27 for preventing a backflow of a refrigerant are installed between an outlet of the compressor 23 and the four-way valve 31.

A receiver 37 for temporarily receiving a refrigerant and a drier 39 for removing moisture contained in a refrigerant are installed in the middle of the first refrigerant path 41, and service valves 45*a* and 45*b* are respectively connected to the first and second refrigerant paths 41 and 42.

In the air conditioner according to the present invention, a refrigerant path is changed by controlling a valve position by the four-way valve 31, thereby performing a heating cycle and a cooling cycle. That is, at the time of the cooling cycle of the air conditioner, a refrigerant compressed in the compressor 23 passes through the four-way valve 31 thus to be introduced into the outdoor heat exchanger 33. Then, the refrigerant passes through the first refrigerant path 41 thus to pass through the indoor expansion device 15 and the indoor heat exchanger 13, and then passes through the four-way valve 31 and the accumulator 35 through the second refrigerant path 42 thus to be introduced into the compressor 23.

The heating cycle of the air conditioner is performed as a reverse cycle of the cooling cycle. That is, the refrigerant compressed in the compressor 23 passes through the second refrigerant path 42 by an operation of the four-way valve 31, and the refrigerant discharged from the indoor unit 11 is introduced into the outdoor heat exchanger 33 through the first refrigerant path 41. Also, the refrigerant which has passed through the outdoor heat exchanger 33 passes through the four-way valve 31 and the accumulator 35 thus to be introduced into the compressor 23.

At the time of the heating cycle, a defrosting cycle for removing frost generated at the heat exchanger 33 is operated. The defrosting cycle is performed similarly to the cooling cycle, but a refrigerant which has passed through the outdoor heat exchanger is not introduced into the indoor unit through the first refrigerant path but passes through the refrigerant detouring path by the first and second three-way valves 57 and 59 thus to be introduced into the compressor 23.

That is, at the time of the defrosting cycle, the refrigerant compressed in the compressor 23 passes through the four-way valve 31 thus to be introduced into the outdoor heat exchanger 33, and the refrigerant discharged from the outdoor heat exchanger 33 passes through the first refrigerant path 41 and the first three-way valve 57 thus to be introduced into the refrigerant detouring path 51. At this time, the refrigerant is not introduced into the indoor unit 11 by the first three-way valve 57. Also, the refrigerant which has passed through the first three-way valve 57 passes through the outdoor expansion device 53 and the heat exchanging unit 55 and passes through the second three-way valve 59 thus to be introduced into the four-way valve 31. At this time, the refrigerant is not introduced into the second refrigerant path 42 by the second three-way valve 57. Also, the refrigerant which has been introduced into the four-way valve 31 passes through the accumulator 35 thus to be introduced into the compressor 23. In said defrosting cycle, the outdoor expansion device 53 and the heat exchanging unit 55 serve as the indoor heat exchanger 13 and the indoor expansion device 15 of the indoor unit 11.

In the air conditioner according to the first embodiment of the present invention, at the time of the defrosting cycle, the refrigerant which has passed through the outdoor heat exchanger 33 is not introduced into the indoor unit 11, but passes through the refrigerant detouring path 51 thus to circulate in the compressor 23, thereby preventing noise generated from the indoor unit 11.

Hereinafter, the outdoor unit for an air conditioner according to another embodiment of the present invention will be explained with reference to FIG. 4. The same components as the aforementioned embodiments will be given the same reference numerals and their explanations will be omitted.

An air conditioner according to another embodiment of the present invention is composed of a plurality of outdoor units 121 and 221 including a compressor 23 and an outdoor heat exchanger 33 and arranged in parallel, and a plurality of indoor units 11 including an indoor heat exchanger 13 and an indoor expansion device 15 and arranged in parallel. Each outdoor unit is connected to one another by main paths 48 and 47 for introducing and discharging a refrigerant to the indoor unit. Each outdoor unit 121 and 221 is similar to the aforementioned first embodiment structurally and operationally.

Figure 4:
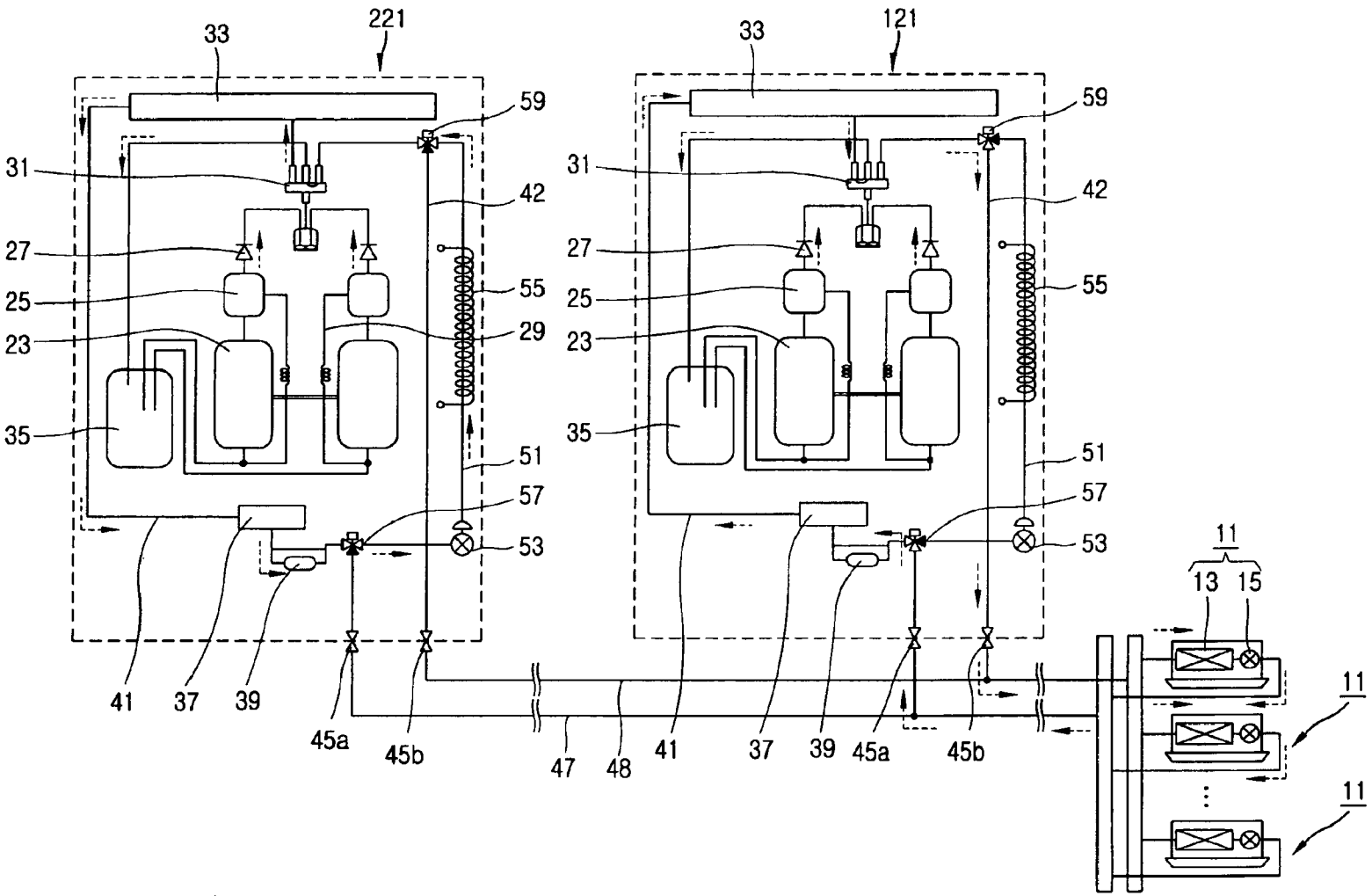
FIG. 4 is a schematic view showing another embodiment of the air conditioner according to the present invention.

The outdoor unit 121 for performing a heating cycle is illustrated on the right side of FIG. 4, and the outdoor unit 221 for performing a defrosting cycle is illustrated on the left side of FIG. 4.

In the air conditioner according to another embodiment of the present invention, at the time of the defrosting operation for removing frost generated at the outdoor heat exchanger 33, a refrigerant is not leaked to outside of the outdoor units 121 and 221 but circulates in the outdoor units 121 and 221. Accordingly, even if the defrosting operation is performed at one outdoor unit of the plurality of outdoor units, the defrosting operation does not influence to other outdoor units or other indoor units, thereby continuing the heating operation of the air conditioner.

In the air conditioner according to another embodiment of the present invention, since the refrigerant which has passed through the outdoor heat exchanger is not introduced into the indoor unit but passes through the outdoor expansion device and the heat exchanging unit thus to circulate in the compressor at the time of the defrosting cycle, a noise generated from the indoor unit is prevented and each outdoor unit can separately perform the defrosting operation. According to this, the defrosting operation is performed in a state that the heating cycle is not stopped thus to prevent indoor heating loss.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An air conditioner comprising an outdoor unit and an indoor unit provided with an indoor heat exchanger and an indoor expansion device, wherein the outdoor unit comprises:

a compressor that compresses a refrigerant;

an outdoor heat exchanger that exchanges heat with the refrigerant;

a four-way valve, positioned adjacent to the compressor, that circulates the refrigerant discharged from the compressor according to one of a heating cycle and a cooling cycle;

a refrigerant detouring path that detours the refrigerant discharged from the outdoor heat exchanger to the compressor during a defrosting operation; and a heat exchanging unit, positioned along the detouring path, that heats the refrigerant.

2. The air conditioner of claim 1, further comprising an outdoor expansion device that reduces a pressure of the refrigerant and is positioned along the detouring path.

3. The air conditioner of claim 2, wherein the outdoor expansion device is an electronic expansion valve.

4. The air conditioner of claim 1, wherein the heat exchanging unit comprises a heat conducting coil which winds around the refrigerant detouring path.

5. The air conditioner of claim 1, wherein the refrigerant detouring path extends between a first refrigerant path, that connects the outdoor heat exchanger and the indoor unit by a first three-way valve, and a second refrigerant path, that connects the four-way valve and the indoor unit by a second three-way valve.

6. The air conditioner of claim 5, further comprising a receiver that temporarily receives the refrigerant passing through the first refrigerant path; and a drier positioned between the first refrigerant path and the first three-way valve, the drier being configured to remove moisture from the refrigerant.

7. The air conditioner of claim 1, wherein the outdoor unit comprises a plurality of outdoor units arranged in parallel.

8. An outdoor unit for an air conditioner, said outdoor unit comprising:

a compressor;

an outdoor heat exchanger that exchanges heat between a refrigerant and external air;

a four-way valve positioned adjacent to the compressor, that changes a flow-path of the refrigerant and circulates the refrigerant according to one of a heating cycle and a cooling cycle;

a first refrigerant path that connects the outdoor heat exchanger to an indoor unit;

a second refrigerant path that connects the four-way valve to the indoor unit;

a refrigerant detouring path connected to the first refrigerant path by a first three-way valve and connected to the second refrigerant path by a second three-way valve, that detours the refrigerant during a defrosting cycle;

an outdoor expansion device positioned along the refrigerant detouring path, that lowers a pressure of the refrigerant in the refrigerant detouring path; and a heat exchanging unit installed between the outdoor expansion device and the second three-way valve, that exchanges heat with the refrigerant which has passed through the outdoor expansion device.

9. The outdoor unit for an air conditioner of claim 8, wherein the heat exchanging unit comprises a heat conducting coil which winds around the refrigerant detouring path.

10. The outdoor unit for an air conditioner of claim 8, further comprising an accumulator between an outlet of the four-way valve and an inlet of the compressor, that filters a liquefied form of the refrigerant.

11. An air conditioner comprising an outdoor unit and an indoor unit provided with an indoor heat exchanger and an indoor expansion device, said outdoor unit comprising:

a compressor that compresses a refrigerant;

an outdoor heat exchanger that exchanges heat with the refrigerant;

a four-way valve positioned adjacent to the compressor, that circulates the refrigerant discharged from the compressor according to one of a heating cycle and a cooling cycle; and a refrigerant detouring path that extends between a first refrigerant path, that connects the outdoor heat exchanger and the indoor unit by a first three-way valve, and a second refrigerant path, that connects the four-way valve and the indoor unit by a second three-way valve.

12. The air conditioner of claim 11, wherein an outdoor expansion device, positioned along the detouring path, reduces a pressure of the refrigerant.

13. The air conditioner of claim 12, wherein a heat exchanging unit that heats the refrigerant is positioned along the detouring path.

14. The air conditioner of claim 13, wherein the heat exchanging unit comprises a heat conducting coil which winds around the refrigerant detouring path.

15. The air conditioner of claim 11, further comprising a receiver that temporarily receives the refrigerant passing through the first refrigerant path; and a drier positioned between the first refrigerant path and the first three-way valve, that removes moisture from the refrigerant.

16. The air conditioner of claim 11, wherein the outdoor unit comprises a plurality of outdoor units arranged in parallel.

* * * * *